US008870605B2

(12) United States Patent
Hung et al.

(10) Patent No.: US 8,870,605 B2
(45) Date of Patent: Oct. 28, 2014

(54) SOCKET CONNECTOR WITH MULTI INSERTION DIRECTIONS

(75) Inventors: Yung-Chih Hung, Jhonghe (TW); Hung-Chi Tai, Jhonghe (TW)

(73) Assignee: Alltop Electronics (Suzhou) Ltd., Taicang, JiangSu Province (CN)

( * ) Notice: Subject to any disclaimer, the term of this patent is extended or adjusted under 35 U.S.C. 154(b) by 157 days.

(21) Appl. No.: 13/604,320

(22) Filed: Sep. 5, 2012

(65) Prior Publication Data

US 2013/0344729 A1 Dec. 26, 2013

(30) Foreign Application Priority Data

Jun. 21, 2012 (CN) ..... 2012 1 0206478

(51) Int. Cl.
*H01R 13/10* (2006.01)
*H01R 24/00* (2011.01)
*H01R 13/11* (2006.01)

(52) U.S. Cl.
CPC ..... *H01R 13/11* (2013.01); *H01R 23/02* (2013.01)
USPC ..... 439/682

(58) Field of Classification Search
CPC ..... H01R 23/725; H01R 23/02; H01R 13/11; H01R 13/112; H01R 13/113; H01R 13/631
USPC ..... 439/682, 224, 218, 31, 374
See application file for complete search history.

(56) References Cited

U.S. PATENT DOCUMENTS 4,274,693 A * 6/1981 Cobaugh et al. ..... 439/374
4,550,964 A * 11/1985 Donais et al. ..... 439/142
4,780,095 A * 10/1988 Classon et al. ..... 439/637
5,167,531 A * 12/1992 Broschard et al. ..... 439/541.5
5,188,535 A * 2/1993 Bertho et al. ..... 439/83
5,486,118 A * 1/1996 Colleran et al. ..... 439/374
5,564,952 A * 10/1996 Davis ..... 439/682
5,951,331 A * 9/1999 Li-Ming et al. ..... 439/682
6,280,217 B1 * 8/2001 Lin ..... 439/260
6,461,178 B1 * 10/2002 Fu ..... 439/224
6,551,143 B2 * 4/2003 Tanaka et al. ..... 439/682
6,630,626 B2 * 10/2003 Johnson et al. ..... 174/138 F
6,666,714 B1 * 12/2003 Li et al. ..... 439/521
6,908,345 B2 * 6/2005 Shimizu et al. ..... 439/682
7,070,456 B1 * 7/2006 Peng et al. ..... 439/682
7,121,848 B2 * 10/2006 Ono ..... 439/83
7,121,901 B1 * 10/2006 Chen ..... 439/718
7,314,377 B2 * 1/2008 Northey et al. ..... 439/79
7,491,096 B1 * 2/2009 Correll ..... 439/716
7,677,919 B1 * 3/2010 Lin ..... 439/500
7,794,289 B1 * 9/2010 Chen et al. ..... 439/682
7,802,994 B1 * 9/2010 Chen et al. ..... 439/65
8,092,236 B2 * 1/2012 Yang et al. ..... 439/83
8,133,063 B2 * 3/2012 Tay ..... 439/83
8,366,497 B2 * 2/2013 Glick et al. ..... 439/839
8,419,482 B1 * 4/2013 Yu et al. ..... 439/682
8,678,849 B2 * 3/2014 Yang et al. ..... 439/374

* cited by examiner

*Primary Examiner* — Amy Cohen Johnson
*Assistant Examiner* — Vladimir Imas
(74) *Attorney, Agent, or Firm* — Sughrue Mion, PLLC

(57) ABSTRACT

A socket connector includes an insulative housing, a number of conductive contacts received in the insulative housing and a protection cover. The insulative housing defines a number of contact-receiving slots. Each contact-receiving slot opens to both a top surface and a front surface of the insulative housing. Each conductive contact includes a contacting portion received in a corresponding contact-receiving slot, and a termination portion extending beyond the insulative housing. The contacting portion includes a pair of contacting sections each forming a recess on a front edge adjacent to said front surface of the insulative housing. The protection cover is disposed to the bottom of the insulative housing.

20 Claims, 7 Drawing Sheets

SOCKET CONNECTOR WITH MULTI INSERTION DIRECTIONS

BACKGROUND OF THE INVENTION

1. Field of the Invention

The present invention relates to an electrical connector, more particularly to a socket connector.

2. Description of Related Art

A conventional socket connector usually comprises an insulative housing and a plurality of conductive contacts received in the insulative housing.

With the development of the technology, there are several ways realize the electrical connection between the socket connector and a corresponding plug connector. Hence, a demand from the customer of realizing the electrical connection in multi directions is raised.

However, the current socket connector and the plug connector only mate with each other along one single direction, cannot realize multi insertion directions. Hence, the restricted mating direction cannot satisfy the multi insertion direction requirement.

Hence, it is necessary to improve the conventional socket connector to address problems mentioned above.

BRIEF SUMMARY OF THE INVENTION

Accordingly, an object of the present invention is to provide a socket connector which provides multi insertion directions.

In order to achieve the above-mentioned object, a socket connector comprises an insulative housing, a plurality of conductive contacts received in the insulative housing and a protection cover. The insulative housing defines a plurality of contact-receiving slots. Each contact-receiving slot opens to both a top surface and a front surface of the insulative housing. Each conductive contact comprises a contacting portion received in a corresponding contact-receiving slot, and a termination portion extending beyond the insulative housing. The contacting portion comprises a pair of contacting sections each forming a recess on a front edge adjacent to said front surface of the insulative housing. The protection cover is disposed to the bottom of the insulative housing.

The foregoing has outlined rather broadly the features and technical advantages of the present invention in order that the detailed description of the invention that follows may be better understood. Additional features and advantages of the invention will be described hereinafter, which form the subject of the claims of the invention.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION OF THE PREFERRED EMBODIMENTS

Figure 1:
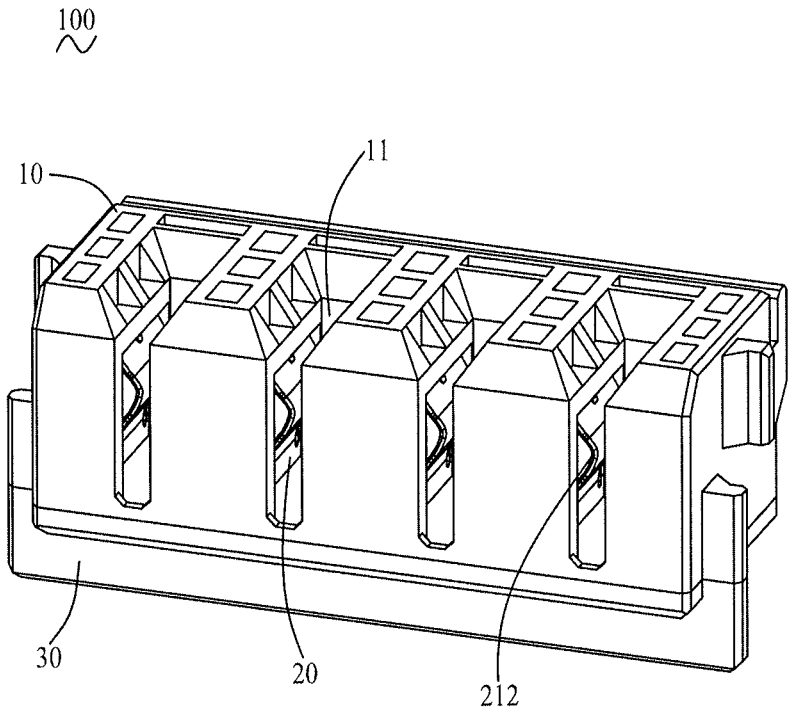
FIG. 1 is an assembled, perspective view of a socket connector in accordance with the present invention.

Reference will be made to the drawing figures to describe the present invention in detail, wherein depicted elements are not necessarily shown to scale and wherein like or similar elements are designated by same or similar reference numeral through the several views and same or similar terminology.

Figure 2:
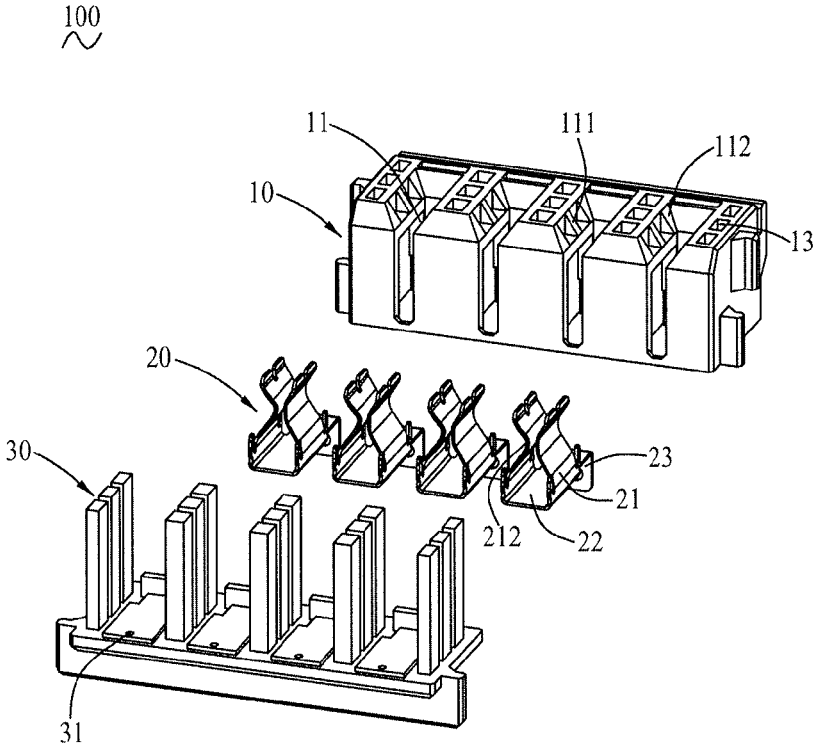
FIG. 2 is an exploded, perspective view of the socket connector of FIG. 1.
Figure 3:
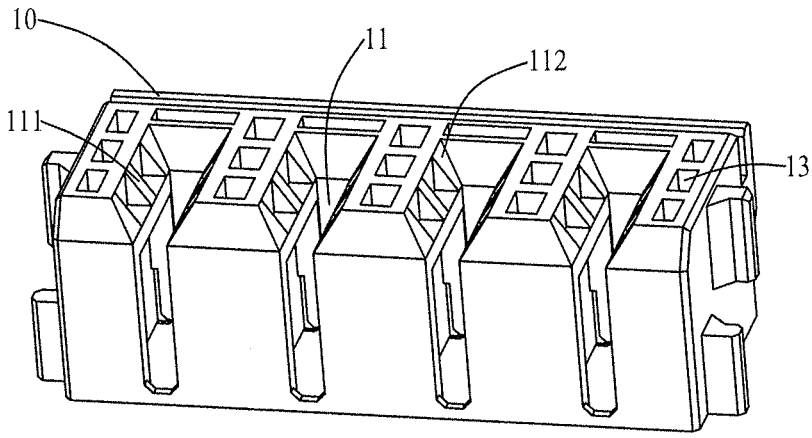
FIG. 3 is a perspective view of an insulative housing of the socket connector shown in FIG. 2.

Referring to FIGS. 1-2, a socket connector 100 in accordance with the present invention comprises an insulative housing 10, a plurality of conductive contacts 20 retained in the insulative housing 10 and a protection cover 30 arranged at the bottom of the insulative housing 10.

Referring to FIGS. 1-5, the insulative housing 10 defines a plurality of contact-receiving slots 11 therethrough along an up-to-down direction. Each contact-receiving slot 11 opens both to a top surface 101 and a front surface 103 of the insulative housing 10. The opposite inner sidewalls 113 are inclined outwardly to form an opening 111 toward outside. The opposite inner surfaces of the opening 111 are a pair of inclined guiding surfaces 112 for guiding the insertion of a complementary connector (not shown) into the socket connector 100 of the present invention.

The contact-receiving slot 11 has a rib 12 protruding downwardly from a bottom surface of a top inner wall 114. Each inner sidewall 113 of the contact-receiving slot 11 defines a pair of slits 15 recessed upwardly from a bottom surface 102 of the insulative housing 10. A plurality of through channels 13 penetrate through the insulative housing 10 along the up-to-down direction and surround the contact-receiving slots 11. Each through channel 13 forms at least one protrusion 14 to form steps on inner sidewalls (not labeled) thereof.

Figure 4:
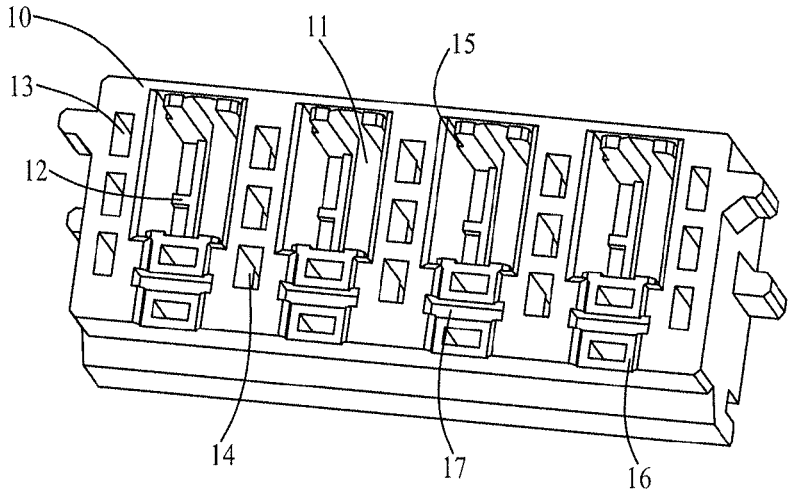
FIG. 4 is a view similar to FIG. 3, but from a different view.
Figure 6:
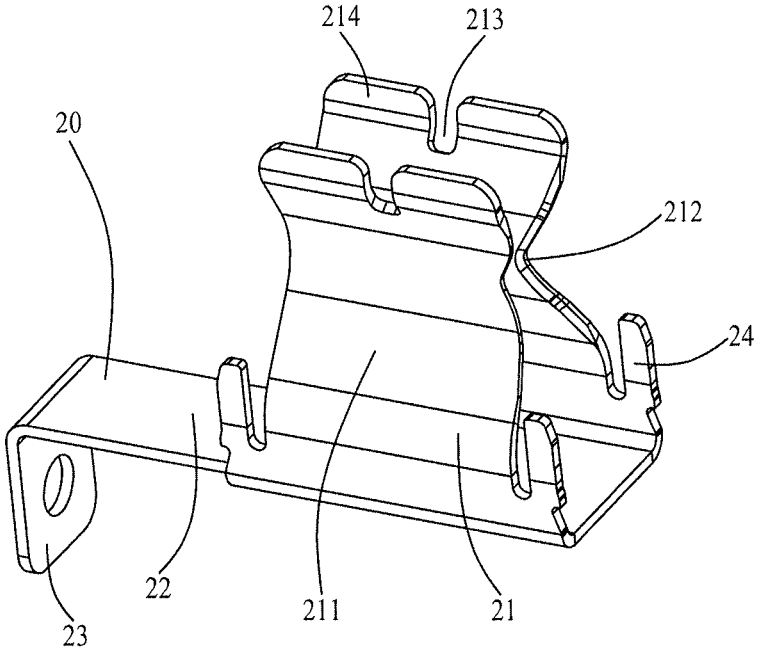
FIG. 6 is an exploded view of a conductive contact shown in FIG. 2.

Referring to FIG. 6 in combination with FIG. 2 and FIG. 4, the conductive contact 20 comprises a contacting portion 21 received in the contact-receiving slot 11, a termination portion 23 extending beyond the insulative housing 10, and a base portion 22 connecting the contacting portion 21 and the termination portion 23. The base portion 22 is of a flat board shape and the contacting portion 21 extends substantially perpendicularly from opposite sides of the base portion 22.

The contacting portion 21 comprises a pair of curved contacting sections 211 extending from opposite sides of the base portion 22 and spaced from each other. A front edge of each contacting section 211 which is adjacent to the front surface 103 of the insulative housing 10 is shaped to form a curved recess 212. The curved recess 212 provides a slanted face with respect to the front surface 103 of the insulative housing 10. The pair of curved recesses 212 can be seen from a front view of the connector. A contact of a complementary connector can be inserted from the front surface 103 of the insulative housing 10 and can be guided by the slanted face. A top edge of the contacting section 211 defines a cutout 213 recessed downwardly therefrom to separate the contacting section 211 into a pair of spaced contacting beams 214.

The opposite sides of the base portion 22 of the conductive contact 20 each form a pair of retaining feet 24 located at opposite sides of the contacting section 211 along a front-to-back direction. The retaining foot 24 is received in the slit 15 of the insulative housing 10. Via the engagement between the rib 12 and the cutout 213, and the engagement between the retaining feet 24 and the slits 15, the conductive contacts 20 are reliably received in the insulative housing 10.

Figure 5:
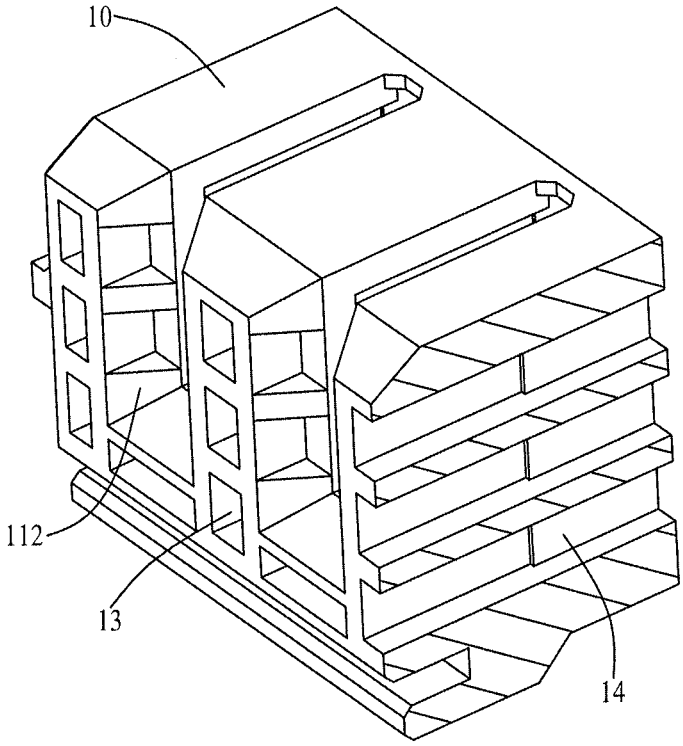
FIG. 5 is a cross-sectional view of the insulative housing.
Figure 7:
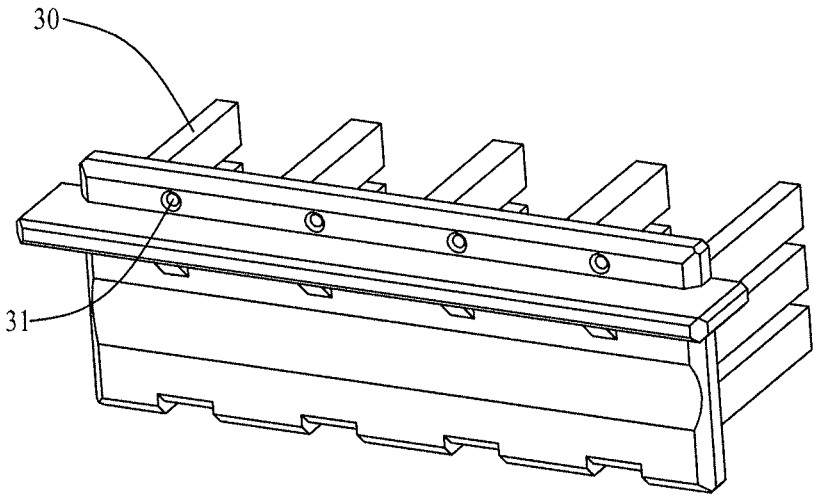
FIG. 7 is an exploded view of a protection cover shown in FIG. 2.

Referring to FIG. 7 in conjunction with FIG. 2 and FIG. 5, the protection cover 30 is insert-molded with the insulative housing 10, the through channels 13 are filled with melted material of the protection cover 30. The protrusions 14 in the through channels 13 are served to increase the interference force between the insulative housing 10 and the protection cover 30. In addition, in alternative embodiments, the through channels 13 also could be cone-shape channel, cone-shape hole or other shapes which could provide step function for enhancing the interference force between the insulative housing 10 and the protection cover 30.

The protection cover 30 defines a plurality of positioning holes 31 for positioning the conductive contacts 20 and the insulative housing 10 by some rivet components (not shown) cooperating with the positioning holes 31. Thus, the socket connector 100 of the present invention is compact in structure and with stable dimensions after insert molding.

Referring to FIG. 4 in conjunction with FIG. 6 and FIG. 7, the insulative housing 10 defines a plurality of receiving recesses 16 recessed along the up-to-down direction and front-to-back direction of the bottom surface 102 of the rear port thereof for receiving the base portions 22 of the conductive contacts 20. An enlarged cavity 17 recesses upwardly and laterally from middle section of the recess 16 to receive melting material of the protection cover 30. Hence, via the cooperation between the base portions 22 of the conductive contacts 20 and the recesses 16 of the insulative housing 10, the waterproof and dustproof effect is enhanced after the insert molding. On the other hand, via the cooperation between the cavities 17 and the melting material of the protection cover 30, the connection stability between the insulative housing 10 and the conductive contacts 20 is achieved.

In summary, the contact-receiving slot 11 of the insulative housing 10 of the socket connector 100 in accordance with the present invention opens to both the top surface 101 and the front surface 103 of the insulative housing 10, and also the contacting section 211 of the conductive contact 20 has curved recess 212 adjacent to the front surface 103 of the insulative housing 10, thus, the socket connector 100 cannot only realize mating with the complementary connector along the opening directions of the contact receiving slots 11, but can also mate with the complementary connector along the curved recess 212 direction of the contacting section 211, thus, realizing multi insertion directions. In other words, the pair of contacting sections 211 are spaced from each other and define a receiving room therebetween towards the top surface 101 of the insulative housing 10. The recesses 212 of the contacting sections 211 face towards the front surface 103 of the insulative housing 10. The contacting sections 211 together with the recesses 212 are such arranged that the complementary connector can alternatively mate with the conductive contacts 21 either from an up-to-down direction or a front-to-back direction. On the other hand, via insert molding the protection cover 30 to the insulative housing 10, and also via the receiving recesses 16 and the cavities 17 which has larger dimension along the lateral direction than that of the receiving recesses 16, the socket connector 100 has compact structure, stable dimensions and perfect waterproof and dustproof effect after insert molding.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed. For example, the tongue portion is extended in its length or is arranged on a reverse side thereof opposite to the supporting side with other contacts but still holding the contacts with an arrangement indicated by the broad general meaning of the terms in which the appended claims are expressed.

What is claimed is:

1. A socket connector, comprising:

an insulative housing defining a plurality of contact-receiving slots, each contact-receiving slot opening to both a top surface and a front surface of the insulative housing;

a plurality of conductive contacts received in the insulative housing and each comprising a contacting portion received in a corresponding contact-receiving slot and a termination portion extending beyond the insulative housing, the contacting portion comprising a pair of contacting sections which define a receiving room therebetween, each forming a recess on a front edge adjacent to said front surface of the insulative housing, said pair of contacting sections spaced from each other and defining the receiving room therebetween towards said top surface of the insulative housing, said recesses of said contacting sections facing towards the front surface of the insulative housing; wherein said contacting sections together with said recesses are arranged such that a complementary connector can alternatively mate with said conductive contacts either from an up-to-down direction or a front-to-back direction; and a protection cover disposed to a bottom surface of the insulative housing.

2. The socket connector as claimed in claim 1, wherein the contact-receiving slot penetrates through the insulative housing and forms a rib on an inner wall thereof.

3. The socket connector as claimed in claim 2, wherein each contacting section of the conductive contact defines a cutout for receiving the rib of the contact-receiving slot of the insulative housing to retain the conductive contact in the insulative housing.

4. The socket connector as claimed in claim 3, wherein the cutout is recessed downwardly from a top edge of each contacting section of the conductive contact to form a pair of contacting beams.

5. The socket connector as claimed in claim 1, wherein the conductive contact further comprises a base portion connecting the contacting portion and the termination portion, and wherein the contacting portion extends substantially perpendicularly from opposite sides of the base portion.

6. The socket connector as claimed in claim 5, wherein the contact-receiving slot further defines a pair of slits on the inner sidewall thereof, and wherein the base portion forms a pair of retaining feet at opposite sides thereof, the retaining feet are retained in the slits to retain the conductive contact in the insulative housing.

7. The socket connector as claimed in claim 6, wherein the retaining feet are located at opposite sides of each contacting section along a front-to-back direction.

8. The socket connector as claimed in claim 5, wherein the insulative housing further defines a plurality of through channels penetrating through the insulative housing along an up-to-down direction, and wherein the through channels surround the contact-receiving slots.

9. The socket connector as claimed in claim 8, wherein the protection cover is insert molded with the insulative housing and fills the through channels, and wherein the through channel forms at least one protrusion on inner sidewall thereof to form a step for increasing the engagement force between the protection cover and the insulative housing.

10. The socket connector as claimed in claim 8, wherein the through channel is of cone-shape channel or cone-shape hole.

11. The socket connector as claimed in claim 9, wherein the insulative housing defines a plurality of receiving recesses recessed upwardly from a bottom surface thereof to receive the base portions of the conductive contacts for increasing the waterproof effect after insert molding the protection cover to the insulative housing.

12. The socket connector as claimed in claim 11, wherein the protection cover defines a plurality of positioning holes to restrict the position of the conductive contacts and the insulative housing when insert molding.

13. The socket connector as claimed in claim 1, wherein the contact-receiving slot has a pair of inclined guiding surfaces on an upper section thereof for guiding the insertion of a complementary connector.

14. A socket connector for mating with a complementary connector, comprising:

an insulative housing defining a plurality of contact-receiving slots, each contact-receiving slot opening to both a top surface and a front surface of the insulative housing;

a plurality of conductive contacts received in the insulative housing, each conductive contact comprising a contacting portion received in a corresponding contact-receiving slot, a termination portion extending beyond the insulative housing, and a base portion connecting the contacting portion and the termination portion, the contacting portion extending perpendicularly from opposite sides of the base portion and providing a pair of contacting sections towards both the top surface and the front surface of the insulative housing so that a contact of the complementary connector can be inserted and electrically connect with the conductive contact either from the front surface or from the top surface; and a protection cover disposed to a bottom surface of the insulative housing.

15. The socket connector as claimed in claim 14, wherein the contact-receiving slot further defines a pair of slits on the inner sidewall thereof, and wherein the base portion forms a pair of retaining feet at opposite sides thereof, the retaining feet are retained in the slits to retain the conductive contact in the insulative housing.

16. The socket connector as claimed in claim 15, wherein the retaining feet are located at opposite sides of each contacting section along a front-to-back direction.

17. The socket connector as claimed in claim 14, wherein the insulative housing further defines a plurality of through channels penetrating through the insulative housing along an up-to-down direction, and wherein the through channels surround the contact-receiving slots.

18. The socket connector as claimed in claim 17, wherein the protection cover is insert molded with the insulative housing and fills the through channels, and wherein the through channel forms at least one protrusion on inner sidewall thereof to form a step for increasing the engagement force between the protection cover and the insulative housing.

19. The socket connector as claimed in claim 18, wherein the through channel is of cone-shape channel or cone-shape hole.

20. The socket connector as claimed in claim 19, wherein the insulative housing defines a plurality of receiving recesses recessed upwardly from a bottom surface thereof to receive the base portions of the conductive contacts for increasing the waterproof effect after insert molding the protection cover to the insulative housing.

* * * * *